US005855771A

United States Patent [19]

Fuerstenau et al.

[11] Patent Number: 5,855,771

[45] Date of Patent: Jan. 5, 1999

[54] PYRITE DEPRESSANT USEFUL IN FLOATION SEPARATION

[76] Inventors: Douglas W. Fuerstenau, 1440 LeRoy Ave., Berkeley, Calif. 94708; Guy H. Harris, 1673 Georgia Dr., Concord, Calif. 94519

[21] Appl. No.: 877,320

[22] Filed: Jun. 17, 1997

Related U.S. Application Data

[60] Provisional application No. 60/019,877 Jun. 17, 1996.

[51] Int. Cl.[6] ..... B03D 1/014; B03D 1/06; B03D 1/012

[52] U.S. Cl. ..... 209/167; 252/61

[58] Field of Search ..... 209/166, 167, 209/901; 252/61

[56] References Cited

U.S. PATENT DOCUMENTS

| | | |
|---|---|---|
| 2,336,868 | 12/1943 | Jayne . |
| 3,093,666 | 6/1963 | Du Brow . |
| 3,220,839 | 11/1965 | Herz . |
| 3,414,128 | 12/1968 | Baarson . |
| 3,426,896 | 2/1969 | Baarson . |
| 5,560,814 | 10/1996 | Burkhart . |

FOREIGN PATENT DOCUMENTS

| | | |
|---|---|---|
| 57-136957 | 8/1982 | Japan . |
| 59-92045 | 5/1984 | Japan . |

*Primary Examiner*—Thomas M. Lithgow
*Attorney, Agent, or Firm*—Harold D. Messner

[57] ABSTRACT

The present invention relates to a process for separating pyrite from sulfide ores and coal during flotation separation which comprises the depressing of pyrite with from about 0.05 to 0.75 kilograms per ton of concentrate solids, using a pyrite depressant compounds selected from the group consisting of $$R1—S(CH_2)_nPO(OH)_2 \quad (I)$$

where n is between 2 and 4, and

R1 is selected from a group consisting of hydrogen (H) and amidine, and (II)

where Ro is a lower alkyl having carbon atoms in a range of 3 to 8 with 3 to 6 being preferred and a final pH in a range of 4 to 9 depending on the ore being processed, and therafter recovering the flotation concentrate thus obtained. As to group (I) compounds, 2-S thironium-ethane phosphonate (TEPA) as a pyrite depressant is surprisingly effective in pyrite removal, being substantially independent of the pH values of the treated ore or coal, compatible with conventional collector reagents such as xanthates in the case of copper sulfide bearing ores as well as being substantially unobtrusive in not depressing other useful ore sulfides, including but limited to chalcopyritoe, bornite, chalcosite, etc. Group (II) are more pH sensitive.

2 Claims, 11 Drawing Sheets

PYRITE DEPRESSANT USEFUL IN FLOATION SEPARATION

RELATED APPLICATION

This is a continuation of Ser. No. 60/019,877 filed Jun. 17, 1996.

SCOPE OF THE INVENTION

The present invention relates to a depressant that is surprisingly effective in depressing pyrite during flotation separation of sulfide ores and coal and more particularly to surprisingly useful depressant that diverts surprisingly large amounts of pyrite on a normalized basis during removal of useful minerals of such ores and/or removal of contaminants (that includes, of course, pyrite) from coal.

BACKGROUND OF THE INVENTION

The need to depress pyrite during flotation of sulfide ores and/or coal is well-known. With particular regard to the former, diverting the pyrite into waste material, significantly upgrade; the concentrates of the result in ores as well as reduces smelting costs since there less sulfur dioxide and sulfuric acid produced as byproducts. With particular regard to the need to depress pyrite in coal, calorific content is improved with its removal, as well as proving a concomitant reduction in sulfur emissions, enabling the user to more easily meet Federal and State regulations.

While a vast array of reagents for pyrite depression have been proposed and reported, we are unaware of use of 2-S thiouronium-ethane phosphonate (TEPA) as a pyrite depressant during both coal and copper sulfide flotation operations, and moreover, we are surprised by the effectiveness thereof in such operations.

SUMMARY OF THE INVENTION

The present invention relates to a process for separating pyrite from sulfide ores and coal during flotation separation which comprises the depressing of pyrite with from about 0.05 to 0.75 kilograms per ton of concentrate solids, using a pyrite depressant compounds selected from the group consisting of $$R1—S\ (CH_2)_nPO\ (OH)_2 \qquad (I)$$

where n is between 2 and 4, and

R1 is selected from a group consisting of hydrogen (H) and amidine, and

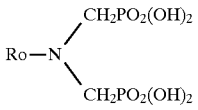

(II)

where Ro is a lower alkyl having carbon atoms in a range of 3 to 8 with 3 to 6 being preferred and a final pH in a range of 4 to 9 depending on the ore being processed, and therafter recovering the flotation concentrate thus obtained. As to group (I) compounds, 2-S thiouronium-ethane phosphonate (TEPA) as a pyrite depressant is surprisingly effective in pyrite removal, being substantially independent of the pH values of the treated ore or coal, compatible with conventional collector reagents such as xanthates in the case of copper sulfide bearing ores as well as being substantially unobtrusive in not depressing other useful ore sulfides, including but limited to chalcopyrite, bornite, chalcosite, etc. Group (II) are more pH sensitive.

STRUCTURAL FORMULA

2-S thiouronium-ethane phosphonate (TEPA) has the following structural formula:

2-isothiouronium-ethane phosphonic acid (TEPA)

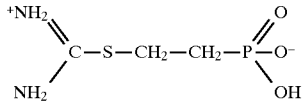

The $pK_a$'s of ethyl phosphonic acid are: $pK_{a1}$=2.43, $pK_{a2}$=8.05

PREPARATION

2-S thiouronium-ethane phosphonate (TEPA) is obtained as follows. A commercially available aqueous solution of o-chloroethane phosphonic acid is heated to 110 to 116 degrees centigrade for four hours. The pH is adjusted to 3.8 and results in the precipitation of $$(H_2N)^+C—S—C_2H_4PO(OH)O^-.$$

The resulting 2-S thiouoronium-ethane phosphonate is about 98% pure.

COAL FLOTATION EXPERIMENTS

Two step batch flotation tests for high-sulfur bituminous coal samples (ILLNOIS NO. 6, PITTSBURGH NO. 8 and UPPER FREEPORT) were conducted in a conventional floatation machine with a two-paddle flotation cell. The first step was performed while maintaining the pulp level to a predetermined mark on the cell, using manual controls. Mechanical scrappers were adjusted to a speed between 0 and 40 rpm. Air flow was controlled by a diaphragm pump connected to a three-way valve and flowmeter assembly.

Table 1 shows the standard floatation test conditions in more detail. Note that purified dodecane was selected as the collector rather than kerosene to gain source independence. The frother was conventional MIBC (methylisobutylcarbinol or 4-methyl-2-penanol). The tailings were filtered, dried, weighed and analyzed.

The concentrate from first step was then re-floated. The pulp was conditioned for about 1 minute, with additional frother (MIBC) being added and conditioned for about 3 minutes (0.58 kg per ton; 0.07 kilograms per ton; and 0.07 kilograms per ton MIBC being added as frother for ILLINOIS NO. 6, PITTSBURGH NO. 8 and UPPER FREEPORT coal samples, respectively). No collector added. After release of air, the froth was collected at different time intervals, viz. at 0.5, 1, 3 and 5 minutes after initialization had been completed.

Filtering, drying, weighing and analyze of the concentrates and tailings been occurred as shown in Table 2 for the above coal sample in per cent of pyritic sulfur rejection as a function of per cent of combustible material recovery (CMR)

Figure 1:
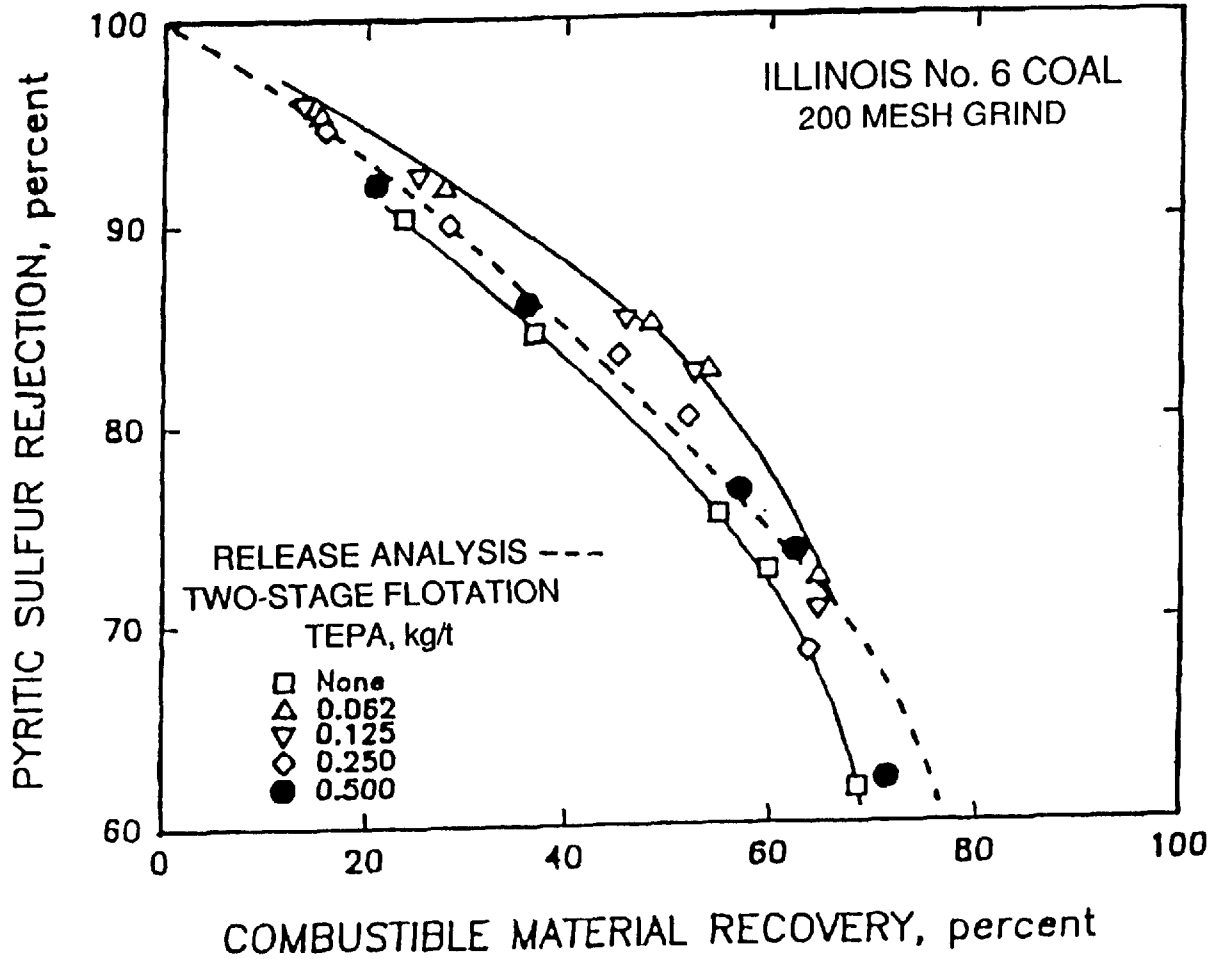
FIGS. 1–3 and 5–11 illustrate the results of the use of 2-S thiouroniuum-ethane-sulfonate to depress pyrites.

In the case of the ILLINOIS NO. 6 sample, FIG. 1 shows that the presence of 2-S thiouronium-ethane phosphonate (TEPA) improved the pyritic sulfur rejection significantly (that is, with respect to results obtained in the absence of TEPA for this sample). Furthermore, separation efficiencies depicted, are also much better than those obtained by a conventional procedure (called "release or tree analysis") normalized to common collector and frother dosages.

In FIG. 1, note that an addition of 0.062 kilograms per ton concentrate solids, of TEPA increases the pyritic rejection at 60 per cent CMR by about 9 per cent with respect to results obtained in the absence of TEPA, and by 4 per cent with respect to results generated by tree analysis (equivalent to 15 per cent to 30 per cent of the remaining pyrite in the concentrates respectively)., Although the improvements noted above in pyritic sulfur rejection is seen to decrease with TEPA dosages over 0.125 kilograms per ton, the results are still superior to those obtained (i) in the absence of TEPA or (ii) by tree analysis.

(Release or tree analysis is a standard procedure to determine best possible separation with standard test conditions. In this procedure the initial feed is floated for 5 minutes in a standard floatation cell but with ¼ of the collector and frother dosages. This assures that most hydrophobic materials is floated first. The tailings are then subjected to a sequence of three more scavenging floatation steps. Each step requires an additional ¼ of both the collector and frother until the final tailings product is obtained. The concentrates generated by the successive floatation of the first, second and third tailings are estimated to have a mass of more than 1% of the initial feed. These concentrates are then submitted to further cleaning. The initial floatation concentrate is also repeatedly floated until all entrapped mineral matter is removed. The tailings fractions associated with initial concentrate are also subjected to further cleaning steps. Both concentrates and tailing are kept separate for individual cleaning and scavenging. Mechanical floatation variables including floatation time are kept constant. Tree analysis is aimed at identifying best possible separation by floatation. A curve thus generated has a locus that represents (a) products of maximum coal matrix content (but minimum ash and pyritic sulfur content), (b) products of the minimum coal matrix content (but maximum ash and pyritic sulfur content) and all other intermediate products in between (a) and (b), supra. Of course collector and frother concentration for each coal sample correspond to that level used in the standard floatation test.)

It is believed TEPA adsorbs onto the pyrite surface by complexing iron, making the latter highly hydrophilic. In addition, TEPA also appears to act as a amphoteric surfactant to modify the surface of both coal and pyrite increasing their positive charge at low TEPA dosages, dispersing the system and improving pyrite rejection as demonstrated by electrokentic, Hallimond tube floatation and rheological studies.

Figure 2:
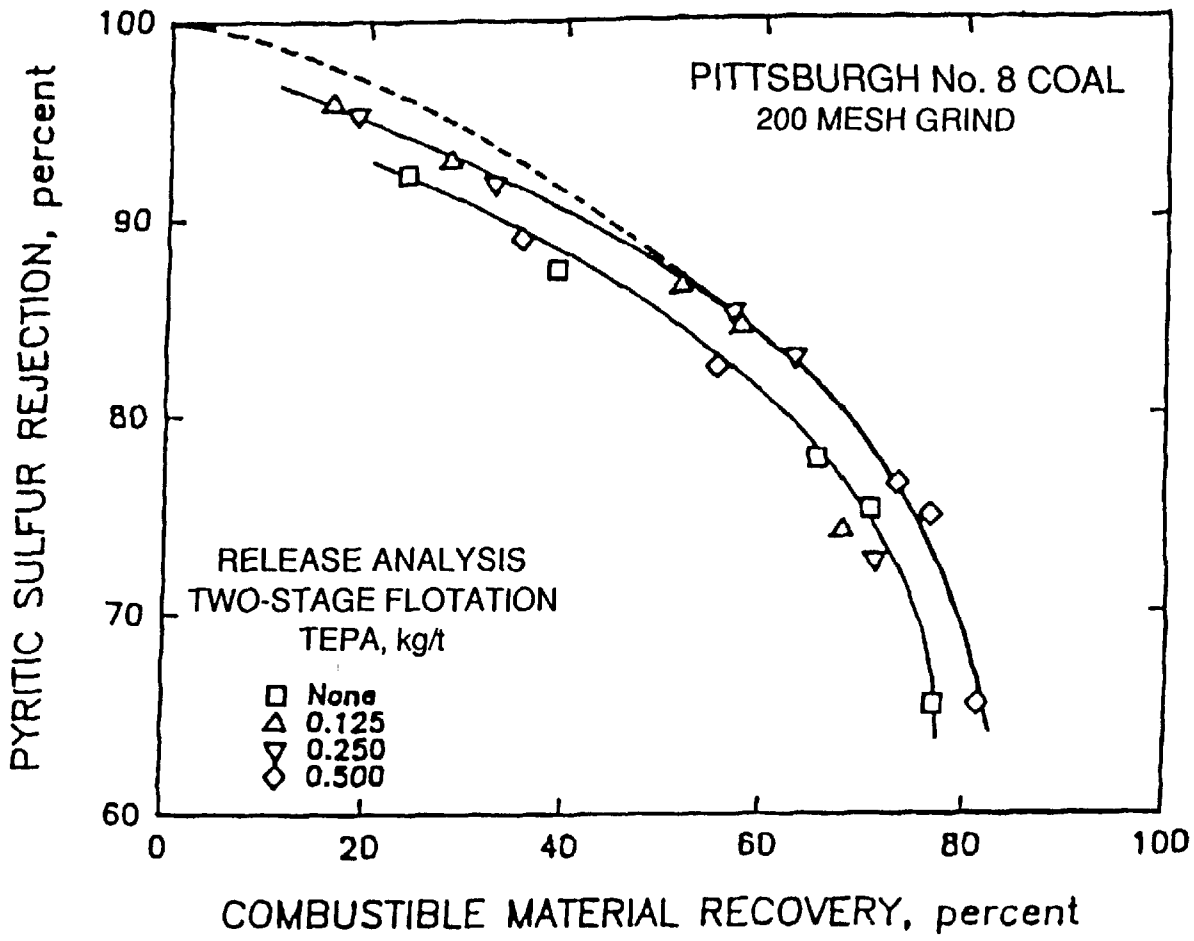

In the case of the PITTSBURGH NO. 8 sample, FIG. 2 shows that the presence of 2-S thironium-ethane phosphonate (TEPA) improved the pyritic sulfur rejection significantly (that is, with respect to results obtained in the absence of TEPA for this sample). Furthermore, separation efficiencies depicted, are also much better than those obtained by release analysis normalized to common collector and frother dosages.

In FIG. 2, note that an addition of 0.062 kilograms per ton of TEPA (over that required for the ILLINOIS NO. 6 sample) is required to improve the level of pyritic sulfur rejection to that obtained by release analysis. This improvement associated with an addition 0.125 kilograms per ton of TEPA corresponds to an increase in 5 per cent pyritic sulfur rejection at 60 per cent CMR with respect to that obtained for floatation tests where there is an absence of TEPA (equivalent to 20 per cent rejection of the remaining pyrite in the concentrate) at the same CMR. The results also match those obtained in the tree analysis tests. Since the pyrite in the PITTSBURGH NO. 8 sample is the believed to be least liberated of the samples, the aforementioned limitations in pyritic sulfur rejection can be so attributed.

Figure 3:
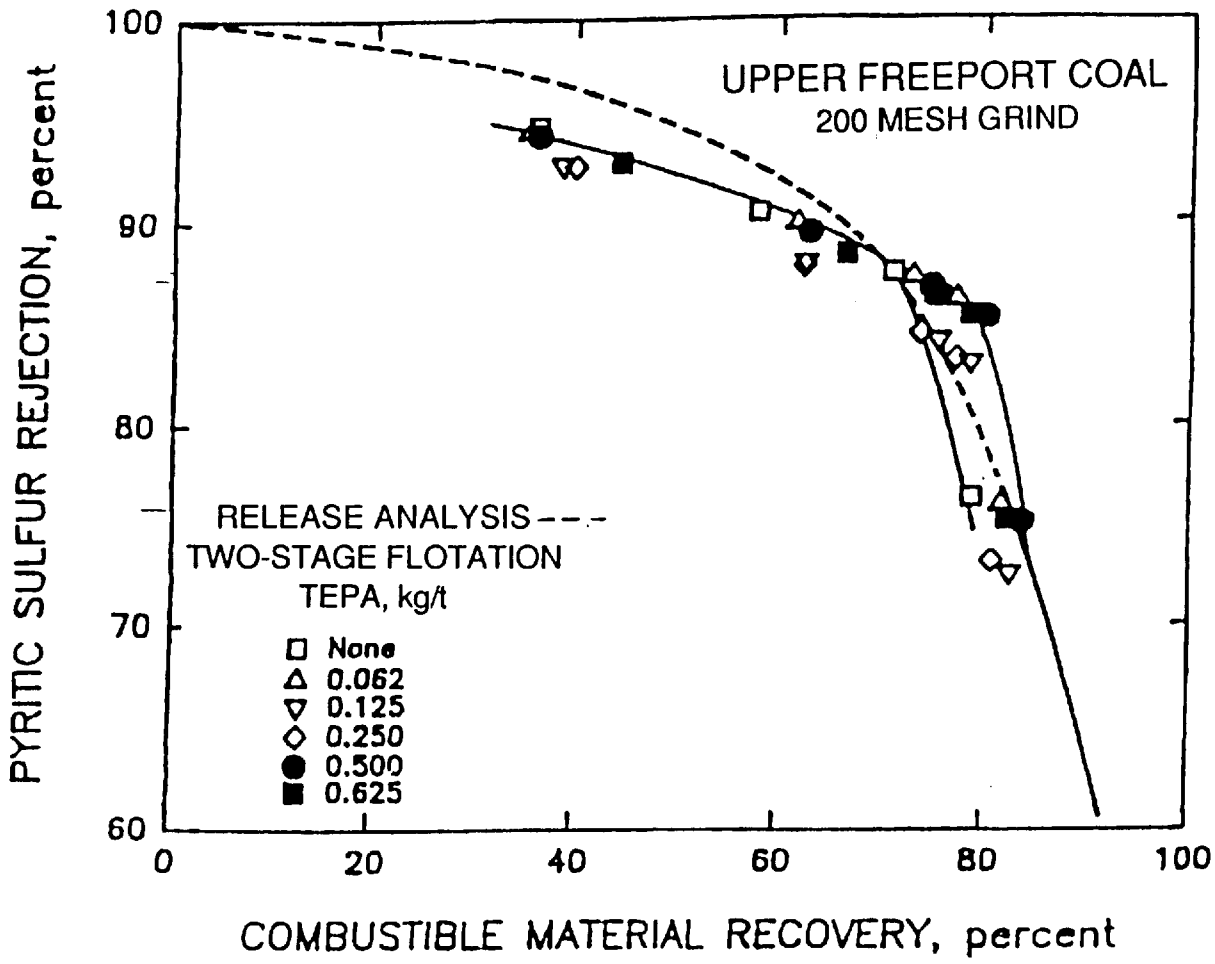

In the case of the UPPER FREEPORT sample, FIG. 3 shows that the presence of 2-S thironium-ethane phosphonate (TEPA) improved the pyritic sulfur rejection even though the UPPER FREEPORT coal sample is most hydrophobic of the three samples.

In FIG. 3, note that an addition of 0.5 kilograms per ton of concentrate solids, of TEPA increases the pyritic rejection at 80 per cent CMR by about 12 per cent with respect to results obtained in the absence of TEPA, and by 6 per cent with respect to results generated by tree analysis (the latter being equivalent to 30 per cent of the remaining pyrite in the concentrate). Further increases in the TEPA dosage not does appear to add significantly to pyritic sulfur rejection than that provided by tree analysis test. This floatation behavior seems to be related to both the decrease in the hydrophobicity of pyrite and the dispersion of the system since coal and pyrite zeta potentials usually become more positive with additions of TEPA.

ORE FLOTATION EXPERIMENTS

OVERVIEW: In the flotation of copper-bearing ores, a collector such as potassium amyl xanthate is added to a slurry of the copper-bearing ore. Purpose: to allow the copper sulfide mineral to become hydrophobic. But iron sulfide minerals (pyrite) may also adsorb the collector and float with the copper minerals. The present invention relates to depressant for such iron sulfide minerals during the flotation of copper sulfide ores without adversely affecting the effectiveness of the latter.

EXAMPLE I

Figure 4:
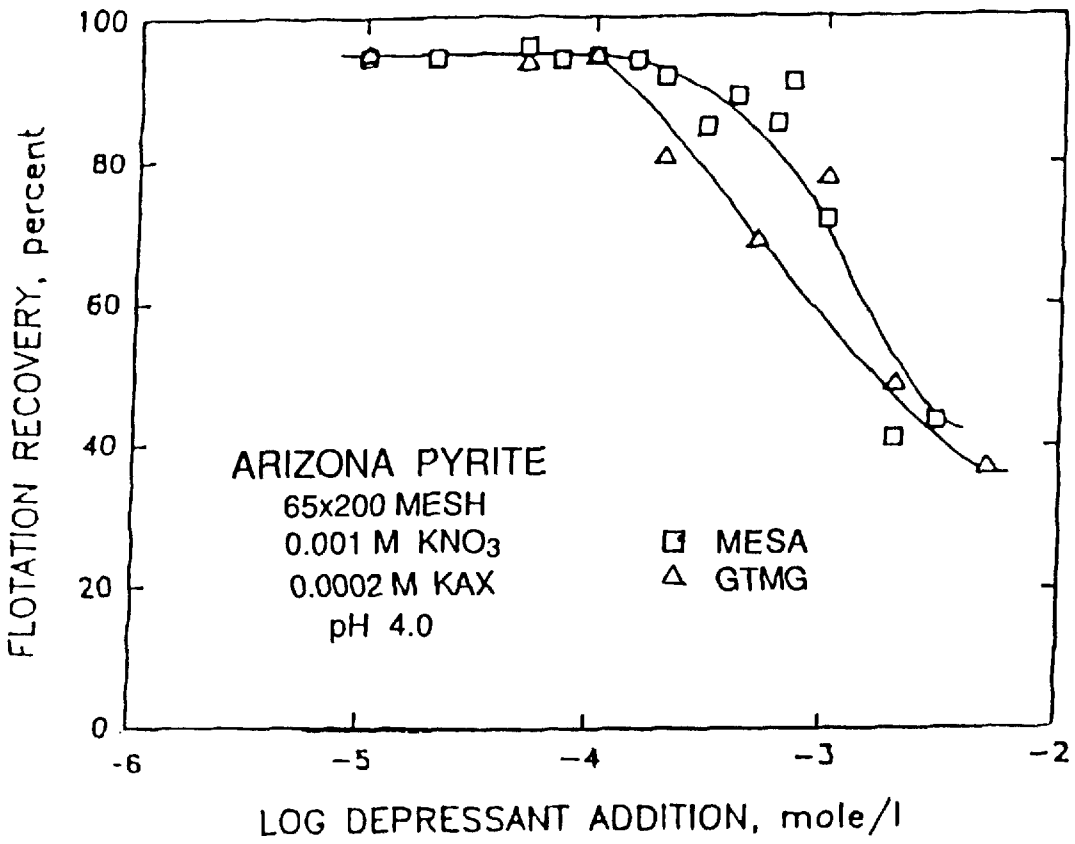
FIG. 4 illustrates the results of the use of conventional depressants.
Figure 5:
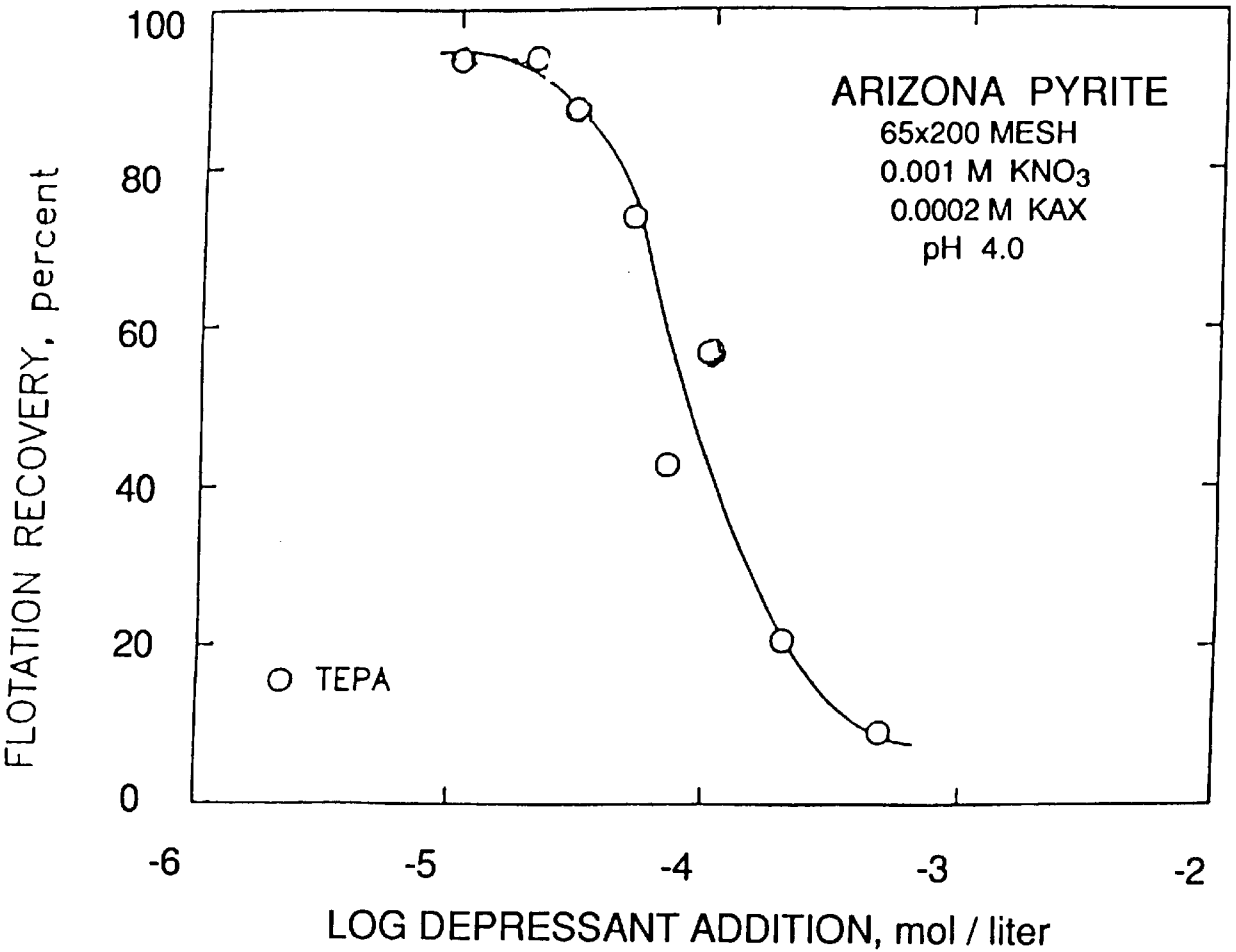

1×10−3 molar solution of potassium nitrate was prepared, adjusting the pH by additions of hydrogen nitrate and potassium hydroxide. A 65×200 mesh sample of a pyrite from Arizona was added to the solution and the resulting system conditioned for 7 minutes using a magnetic stirrer. After 4 minutes of conditioning, potassium amyl xanthate (KAX) was added and then the resulting suspension conditioned for three more minutes. For the evaluation of TEPA, TEPA was added to the suspension in amounts indicated in FIG. 4. After the suspension was conditioned to a pH of 4, a 2×10−4 molar solution of KAX was added. After final conditioning, the pH was recorder and the suspension was transferred to a modified Hallimond tube where the material was floated for one minute using a nitrogen flow of 50 cubic centimeters per minute. Both the concentrate and tailings were filtered, dried and weighted. Thereafter the tests were repeated using conventional pyrite depressants, viz., mercapto-ethane sulfonic acid (MESA) and glycerylmonothioglycolate (GMTG). The results are shown in FIG. 4 and 5. Note that TEPA is shown to react surprisingly strongly with surface of pyrite as compared to MESA and GMTG, requiring 20 times less reagent for maximum depression of the system (less than 20% recovery) while the latter only provide for depression efficiency slightly under 40% recovery. It is believed that the strongly negative functional group in TEPA complexes iron on the surface of the pyrite, rendering the surface hydrophilic.

EXAMPLE II

A Temagami copper ore was prepared in a similar manner as the pyrite of EXAMPLE I, for comparison purposes. With TEPA added, the ore was floated and the tests shown in FIG. 6 obtained.

Figure 6:
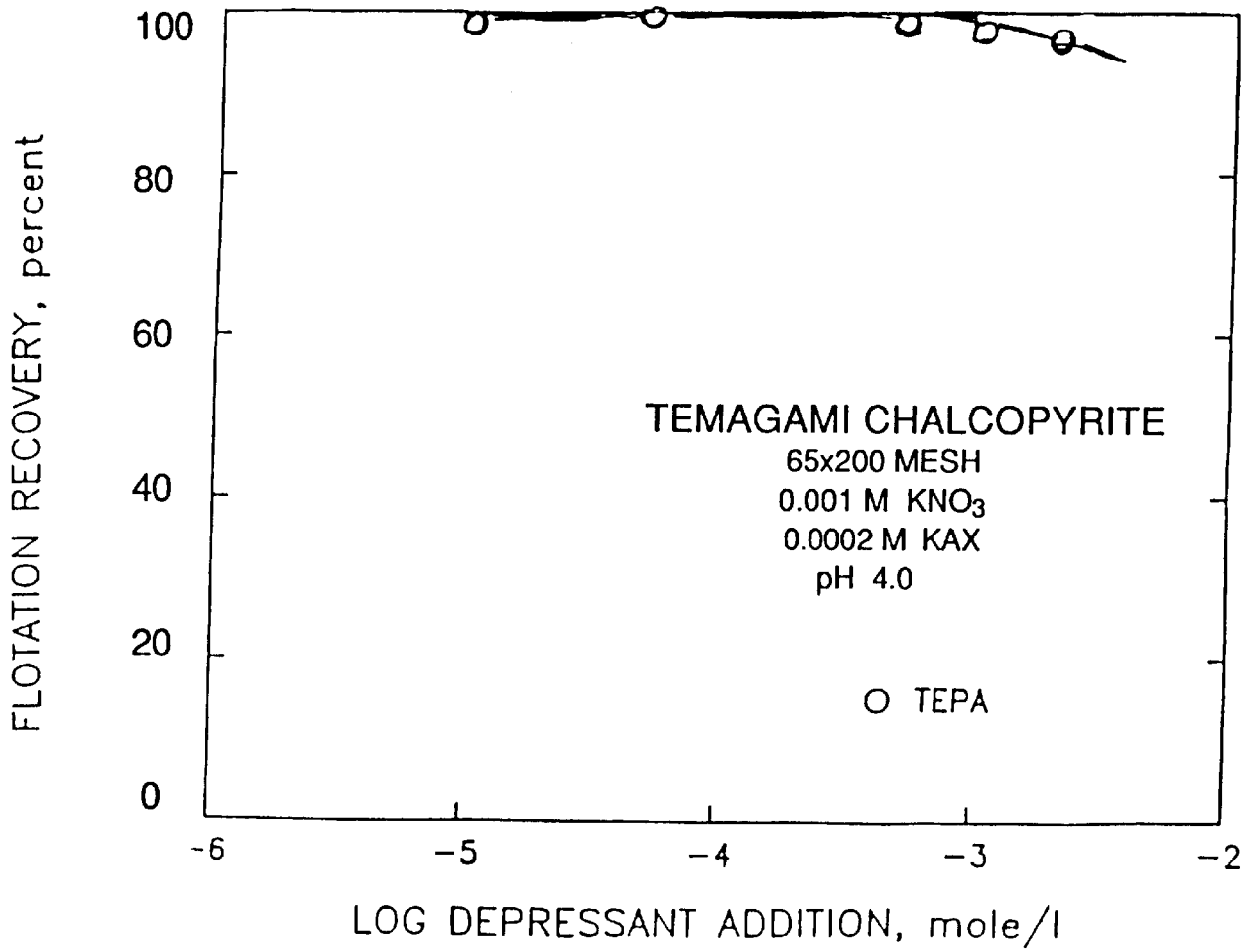

FIG. 6 indicates that TEPA does not affect the flotation behavior of the copper since no depression of the system is indicated. The selectivity of TEPA for pyrite only, is thus assured.

EXAMPLE III

A Southwestern U.S. copper ore (−10 mesh) was prepared by crushing. After blending and splitting the sample was divided in 500 gram subsamples (dry basis). Argon was used as purging gas. The subsample was then reground to 67 weight per cent solids content. For the evaluation of TEPA, 0.092 kilograms per ton of TEPA were added. After further conditioning lime was added (0.2 to 0.4 kilograms per ton) to attain a pH of 9.5. A conventional collector was added (0.04 kilograms per ton Minerec M200).

Figure 7:
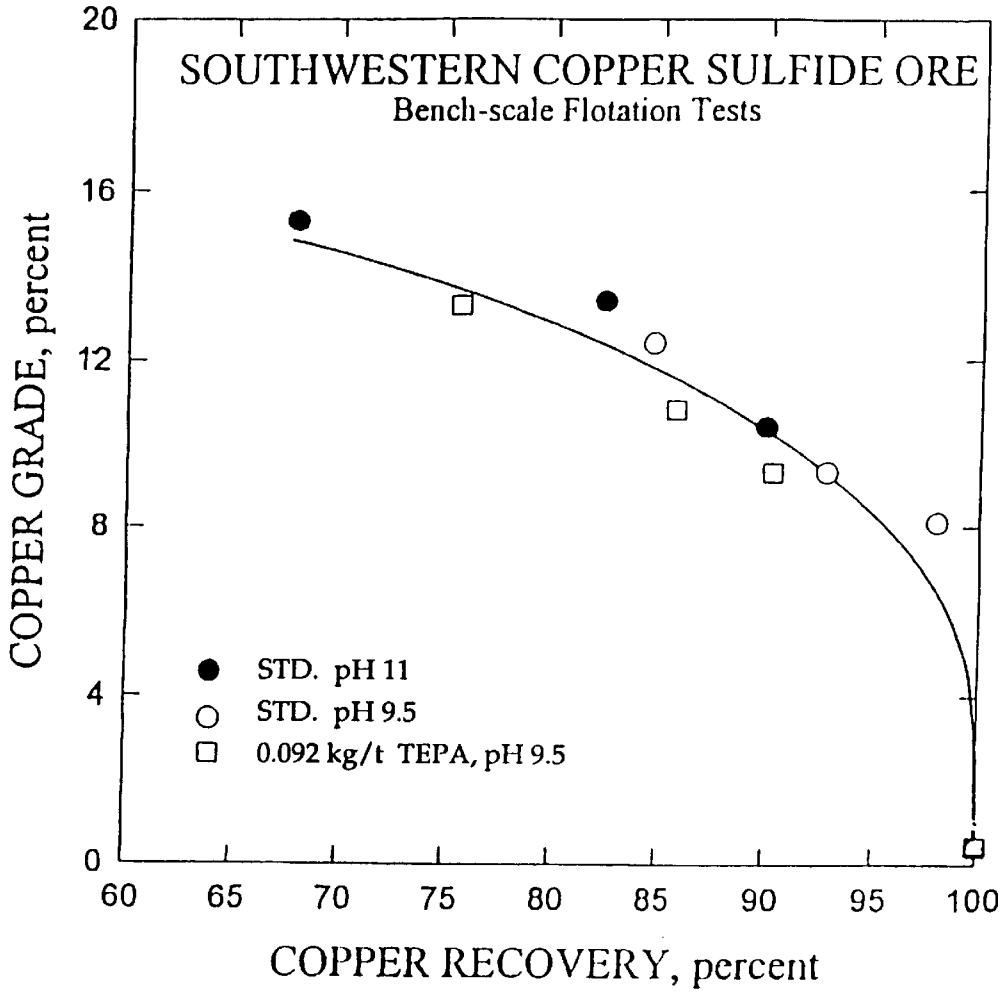

The slurry was then transferred to a conventional flotation machine. The pH was measured. Then, 0.012 kilogram per ton MIBC was added for 3 minutes. The sample was then floated. More collector and MIBC were added and conditioned. The sample was again floated. There was a repeat of the last mentioned step to obtain the final tailings. Three rougher concentrates collected separately and tailing were filtered, dried, weighed and analyzed for copper and iron using a spectrophotomer. Metallurgical calculations were performed. Comparisons with MESA and/or GMTG as reagents were made as depicted in FIG. 7. An additional run at a pH of 11 for MESA and/or GMTG was also made and those results are also shown in FIG. 7.

FIG. 7 indicates that TEPA does not affect the flotation behavior of the copper since no depression of the system is indicated. The selectivity of TEPA for pyrite only, is thus assured.

EXAMPLE IV

A South American copper ore was prepared in a manner akin to that set forth in EXAMPLE III, with the following differences. In the grinding step, a 500 gram subsample was ground to a 80 per cent 200 mesh subsample. The pH was modified by the addition of lime at a rate of 0.2 kilograms per ton. No collector was used. The flotation tests were performed using 0.02 kilograms per ton of isopropyl xanthate (NaIPX). A larger amount of MIBC was used (0.25 kilograms per ton). The system was floated for two minutes. At the next stages, 0.01 kilograms per ton of NaIPX was added and conditioned for about 4 minutes. Then 0.0125 kilograms per ton of MIBC was added and the slurry conditioned. Comparisons with MESA and/or GMTG as reagents were made as depicted in FIGS. 8–10.

Figure 8:
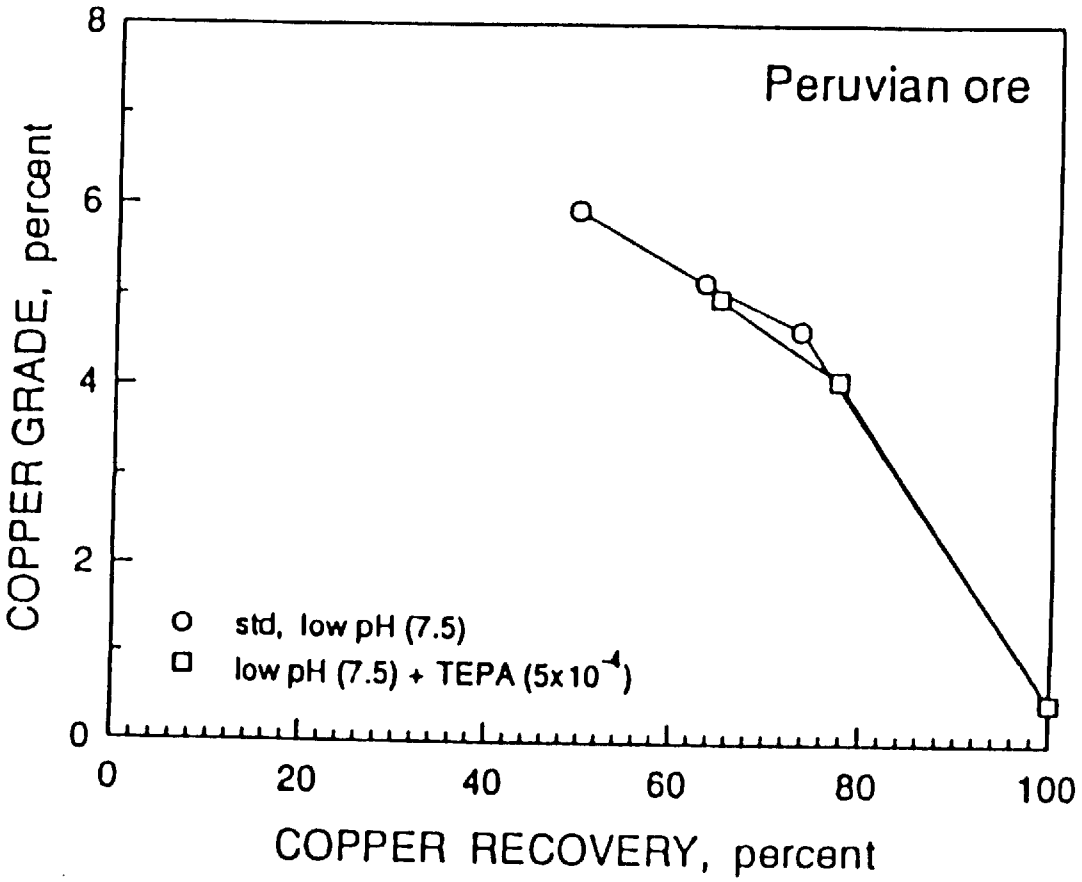
Figure 9:
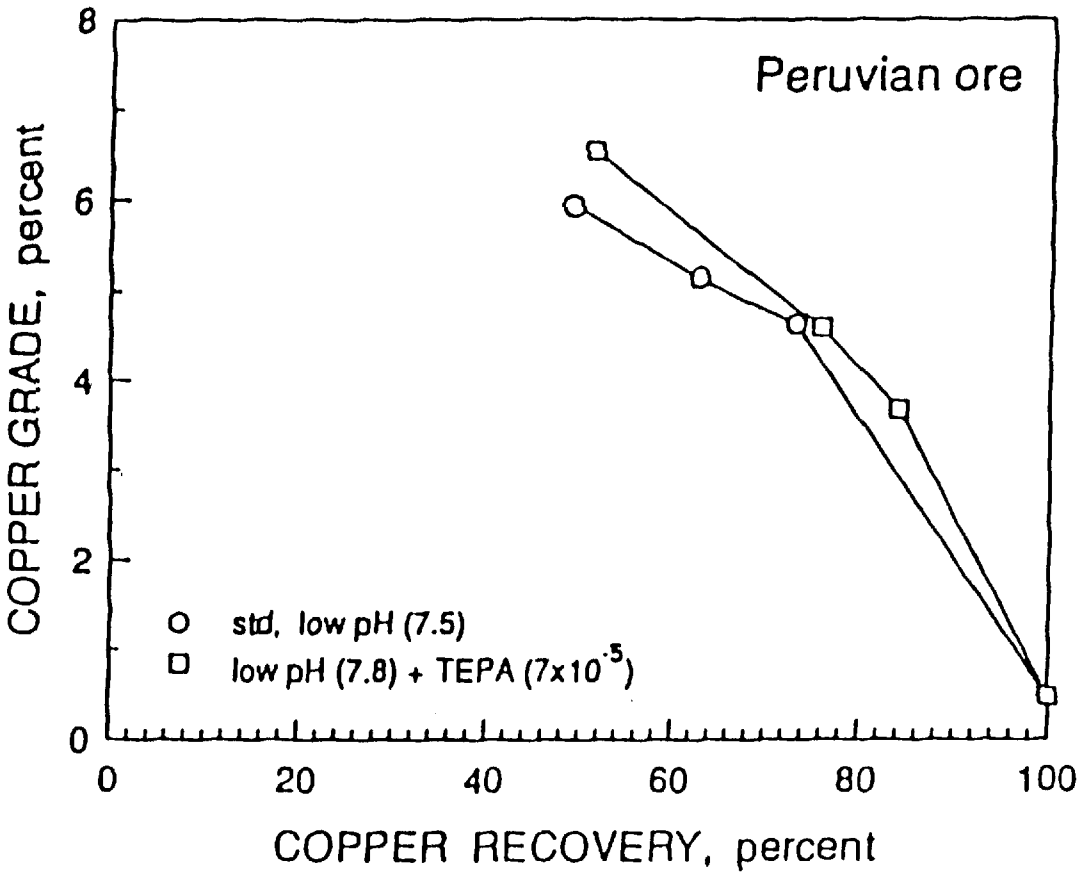

FIG. 8 and 9 indicate that TEPA at the concentrations and pH's indicated, does not affect the flotation behavior of the copper since no depression of the system is indicated. The selectivity of TEPA for pyrite only, is thus assured.

Figure 10:
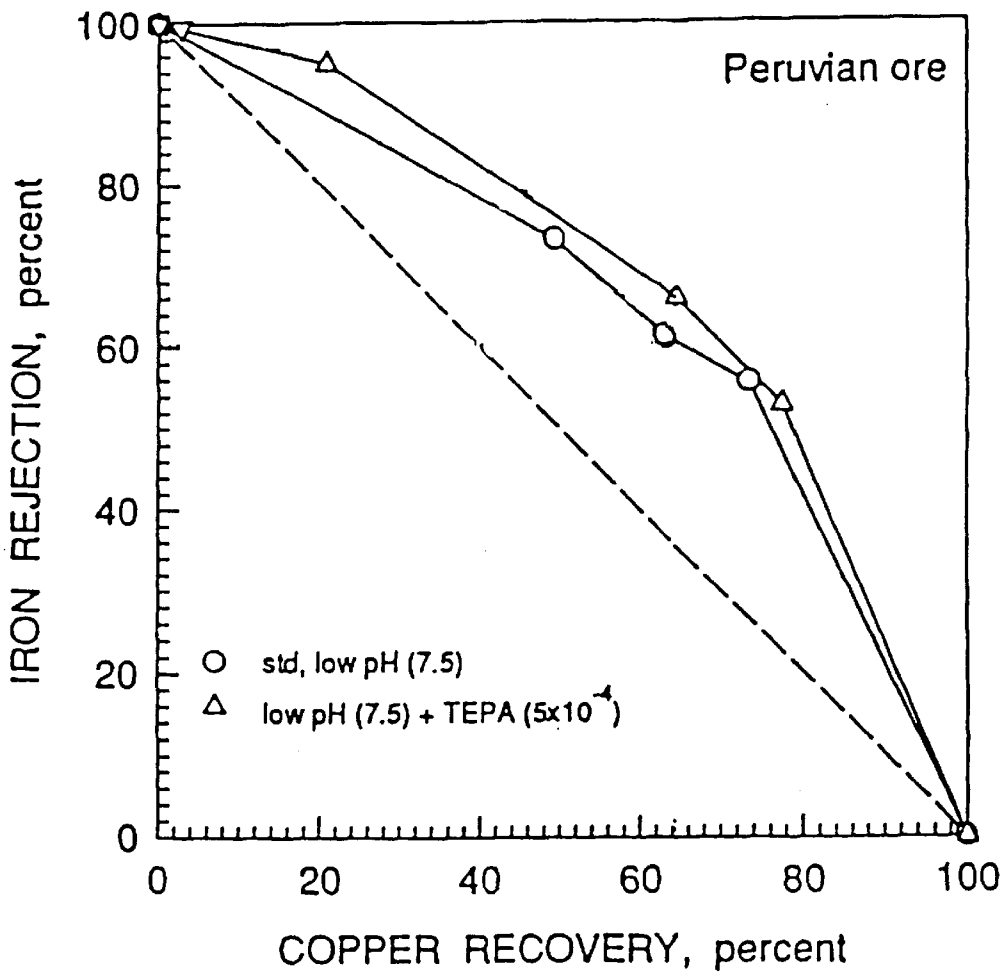

FIG. 10 indicates that TEPA at the concentrations indicated, is a better pyrite depressant than a conventional standard such as set forth above. Note in FIG. 10 that at 80% copper recovery the iron rejection is only about 50 per cent. The reason is based on the character of the ore which are termed "locked particle" wherein the pyrite and copper are interlaced in varying amounts. If such particle is floated, then the grade of the copper concentrate is reduced. Similarly, if the particle is depressed, then copper recovery is reduced. In practice, the rougher concentrate represents a smaller portion of the ore and regranting the former leads to increased effectiveness and lower costs. Regrinding liberates more copper and iron minerals.

Whereas there are here specifically set forth certain preferred procedures which are presently regarded as the best mode for carrying out the invention, it should be understood by one skilled in the art, that various changes, modifications and improvements can be made and other procedures adapted without departing from the scope of the invention particularly pointed out and claimed hereinbelow.

For example, a family of compounds having the same characteristics as set forth above of the following general formula, are of likewise extreme value in the prior amounts for use in the processes set forth above:

$$R1—S\ (CH_2)_n PO\ (OH)_2$$

where n is between 2 and 4, and

R1 is selected from a group consisting of hydrogen (H) and amidine.

COMPOUND GHB-2

Figure 11:
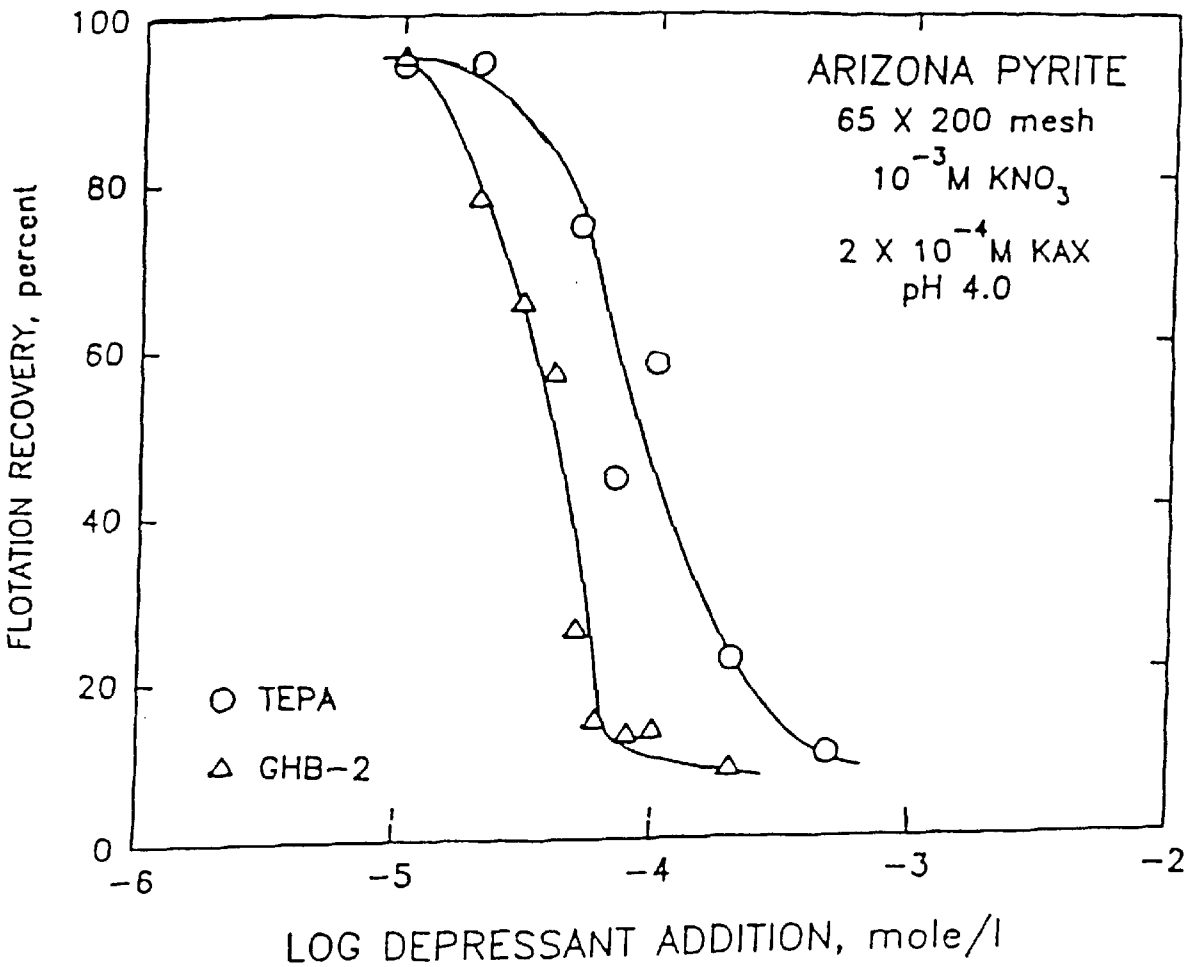

The compound GHB-2 is a compound containing in the molecule one or more nitrilodiacetate groups and nitrolotriacetic acid (NTA) of the following general formula:

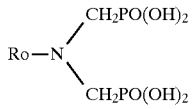

where Ro is a lower alkyl having carbon atoms in a range of 3 to 8 with 3 to 6 being preferred and a final pH in a range of 4 to 9 depending on the ore being processed. Note in FIG. 11, the compound GHB-2 in which Ro is a lower alkyl having six carbon atoms, provides superior results in comparison with TEPA.

Preparation of the compound GH-2 is a set forth in the article entitled "THE DIRECT SYNTHESIS OF ALPHA-AMINOMETHYLPHOSPHONIC ACIDS. MANNISH-TYPE REACTIONS WITH ORTHOPHOSPHOROUS ACID", Kurt Moedritzer et al, Journal of Organic Chemistry, May, 1966.

We claim:

1. Process for separating pyrite from sulfide ores and coal which comprises subjecting said sulfide ore or coal containing said pyrite to flotation in the presence of a depressant for pyrite, said depressant comprises about 0.05 to 0.75 pounds per ton of a pyrite depressant selected from the group consisting of $$R1—S\ (CH_2)_n PO\ (OH)_2 \qquad (I)$$

where n is between 2 and 4 and

R1 is amidine.

2. The process of claim 1 in which group (I) is 2-S thiouronium-ethane phosphonate (TEPA).

* * * * *

UNITED STATES PATENT AND TRADEMARK OFFICE
Certificate

Patent No. 5,855,771 Patented: January 5, 1999

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Douglas W. Fuerstenau, Berkeley, CA; Guy H. Harris, Concord, CA; and Francisco J. Sotillo, Lakeland, FL.

Signed and Sealed this Thirtieth Day of July 2002.

DAVID A. SIMMONS
*Supervisory Patent Examiner*
Art Unit 1724